US009816364B2

(12) United States Patent
Kruspe et al.

(10) Patent No.: US 9,816,364 B2
(45) Date of Patent: Nov. 14, 2017

(54) WELL STIMULATION METHODS AND PROPPANT

(71) Applicant: BAKER HUGHES INCORPORATED, Houston, TX (US)

(72) Inventors: Thomas Kruspe, Wietzendorf (DE); Rocco DiFoggio, Houston, TX (US)

(73) Assignee: BJ SERVICES, LLC, Tomball, TX (US)

( * ) Notice: Subject to any disclaimer, the term of this patent is extended or adjusted under 35 U.S.C. 154(b) by 0 days.

(21) Appl. No.: 14/036,423

(22) Filed: Sep. 25, 2013

(65) Prior Publication Data

US 2015/0083418 A1 Mar. 26, 2015

(51) Int. Cl.
*E21B 43/267* (2006.01)

(52) U.S. Cl.
CPC ..... *E21B 43/267* (2013.01)

(58) Field of Classification Search
CPC ..... E21B 43/267
USPC ..... 166/280.1, 280.2
See application file for complete search history.

(56) References Cited

U.S. PATENT DOCUMENTS 5,921,317 A * 7/1999 Dewprashad ..... E21B 43/267 166/280.1
7,207,386 B2 4/2007 Brannon et al.
7,464,764 B2 12/2008 Xu
7,806,181 B2 10/2010 Barmatov
7,909,099 B2 * 3/2011 Thiercelin ..... E21B 33/138 166/281
7,931,084 B2 4/2011 Nguyen et al.
2006/0211580 A1 * 9/2006 Wang ..... C09K 8/32 507/209
2008/0108524 A1 * 5/2008 Willberg ..... C09K 8/035 507/225
2009/0176667 A1 * 7/2009 Nguyen ..... C09K 8/70 507/204
2010/0089581 A1 * 4/2010 Nguyen ..... C09K 8/685 166/280.2
2011/0036583 A1 2/2011 Willberg et al.
2011/0120713 A1 * 5/2011 Todd ..... C04B 28/02 166/280.1
2014/0060829 A1 * 3/2014 Nguyen ..... C09K 8/80 166/280.1
2014/0083696 A1 * 3/2014 Nguyen ..... C09K 8/805 166/280.2

(Continued)

OTHER PUBLICATIONS

Non-Explosive Controlled Breaking, Cutting and Demolition Agent. Fact Sheet [online]. 2 pages. Dexpan International, [retrieved on Jul. 30, 2013]. Retrieved from the Internet: www.DexpanInternational.com.

(Continued)

*Primary Examiner* — Doug Hutton
*Assistant Examiner* — Charles Nold
(74) *Attorney, Agent, or Firm* — Parsons Behle & Latimer

(57) ABSTRACT

A well stimulation method includes using a well formation containing fractures and placing proppant in the fractures. A plurality of individual particles of the proppant includes a core containing a swellable material. The method includes swelling the core and increasing a size of the fractures using the swelling core. A proppant particle includes a core containing a swellable material and a dissolvable layer encapsulating the core.

26 Claims, 1 Drawing Sheet

(56) References Cited

U.S. PATENT DOCUMENTS

2014/0332213 A1* 11/2014 Zhou ..... C09K 8/685 166/280.2
2015/0016426 A1* 1/2015 Merlin ..... H04W 72/0466 370/335
2016/0145488 A1* 5/2016 Aines ..... E21B 43/267 166/280.2

OTHER PUBLICATIONS

How to use Dexpan to break concrete & rock [online]. 8 pages. Dexpan [retrieved on Jul. 30, 2013]. Retrieved from the Internet: www.dexpan.com/dexpan-how-to-use-dexpan-non-explosive-control.
Dexpan Non-Explosive Demolition Agent. Material Safety Data Sheet [online]. 9 pages. Dexpan, [retrieved on Jul. 30, 2013]. Retrieved from the Internet: www.archerusa.com.
[Retrieved on Jul. 30, 2013]. Retrieved from the Internet: Bustar Technical Bustar Expanding Grout, Expansive Grout Non-Explosive Expansive Grout Concrete Demolition. [online]. 1 page. http://www.demolitiontechnologies.com/expanding-grout-technical-info.
Dexpan MSDS Expansive Demolition Grout Material Safety Data Sheet [online]. 2 pages. Dexpan, [retrieved on Jul. 30, 2013]. Retrieved from the Internet: http://www.dexpan.com/dexpan-safety-dexpan-concrete-demolition-rock-breaking-explosive-blasting.aspx.
Dexpan, Demolition Non Explosive Controlled Blasting Demolition Agent [online]. 1 page. Dexpan, [retrieved on Jul. 30, 2013]. Retrieved from the Internet http://www.archerusa.com/nonexplosivesblastingdemolition/product_dexpandemolitionagent.html.
Bustar Chemical Demolition Agents, Controlled Rock Demolition Chemicals [online]. 1 page. Bustar Chemical Demolition Agents. [retrieved on Jul. 30, 2013]. Retrieved from the Internet http://www.demolitiontechnologies.com/chemical-demolition-agents.htm.
Bustar, Non-Explosive Demolition Agent, Material Safety Data Sheet [online]. 2 pages. Bustar Chemical Demolition Agents [retrieved on Jul. 30, 2013]. Retrieved from the Internet http://www.demolitiontechnologies.com/images/uploaded/BUSTAR_MSDS.pdf.
Palmer, Demolition the Easy Way, Concrete Construction, Mar. 30, 2012 [online]. 8 pages. [retrieved on Jul. 30, 2013]. Retrieved from the Internet http://www.concreteconstruction.net/repair/demolition-the-easy-way.aspx.
Daigh Company Inc., MSDS and Safety Information, Rock Splitting Mortar [online]. 1 page. [retrieved on Jul. 30, 2013]. Retrieved from the Internet http://www.daighcompany.com.
Rush, James W. Expansive Mortar Assists Microtunneling Job in Baltimore, Dec. 2006 [online]. 2 pages. [retrieved on Jul. 30, 2013]. Retrieved from the Internet www.daighcompany.com.
Daigh Company, Bristar Brochure, Mar. 19, 2003, 13 pages. Retrieved from the Internet www.daighcompany.comhttp://www.phmsa.dot.gov/staticfiles/PHMSA/Interpretations/.../100222.pdf.
Bristar Material Safety Data Sheet, Sep. 24, 2010. 3 pages. Retrieved from the Internet www.daighcompany.comhttp://www.phmsa.dot.gov/staticfiles/PHMSA/Interpretations/.../100222.pdf.
Rock Frac Rock Splitting Product Information Sheet [online]. 2 pages. Enterprising Europa. Info@the EEIgroup.com. [retrieved on Jul. 30, 2013]. Retrieved from the Internet http://www.rockfrac.com/home.php/.
RockFrac MSDS [online]. 2 pages. Enterprising Europa. Info@the EEIgroup.com. [retrieved on Jul. 30, 2013]. Retrieved from the Internet http://www.rockfrac.com/msds.php.
Fract AG Expantion Powder for Crushing or Cutting Rocks and Concrete Product Information Sheet [online]. 1 page. [retrieved on Jul. 30, 2013]. Retrieved from the Internet www.greecexplorer.com/kardolamas/fract-ag_engl.html.
Dextec, Ter-Mite UK Product Information [online]. 1 page. [retrieved on Jul. 30, 2013]. Retrieved from the Internet www.ter-mite.com/ter-mite/4520226361.
Bristar Expansive Mortar, Vendita cement demolition [online] 1 page. [retrieved on Jul. 30, 2013]. Retrieved from the Internet www.nonex.it/english/bristar.htm.
Betonamit Crowder Supply Product Information Sheet [online] 1 page. [retrieved on Jul. 30, 2013]. Retrieved from the Internet www.crowdersupply.com/betonamit.htm.
Wikipedia, Non-explosive demolition agents [online] 1 page. [retrieved on Jul. 30, 2013]. Retrieved from the Internet en.wikipedia.org/wiki/Non-explosive_demolition_agents.
Maansi Exims, Expansive Mortar, What is Expansive Mortar (soundless stone cracking powder)? [online] 2 pages. [retrieved on Jul. 30, 2013]. Retrieved from the Internet www.maansiexims.com/expansivemortar.php.
Peri Nitrates Pvt. Ltd., Expansive Mortar [online] 2 pages. [retrieved on Jul. 30, 2013]. Retrieved from the Internet www.perinitrates.com/expansive-mortar.html.
Blog by Boulder Bustar, ChemBreak—Expansive Mortar, Aug. 10, 2011 [online] 2 pages. [retrieved on Jul. 30, 2013]. Retrieved from the Internet www.boulderbuster.ca/Blog.php/chembreak-expansive-mortar.
Expando, cracks rocks and concrete [online] 2 pages. [retrieved on Jul. 30, 2013]. Retrieved from the Internet www.expando.com.au/.
Saint-Gobain Proppants, Conductivity Matters, Fort Smith AR. 7 pages. www.proppants.saitn-gobain.com.
Lafollette, Randy, Key Considerations for Hydraulic Fracturing of Gas Shales, Sep. 9, 2010. 53 pages. Shale Gas Technology, BJ Services Company.
Lyle, Don, Proppants Open Production Pathways, Hart Energy Publishing, 6 pages. Copyright, Hart Energy Publishing, Houston, TX US.
Polycondensation and Polymeric Membranes Group, Water Purification, [online] 1 page. [retrieved on Jul. 30, 2013]. Retrieved from the Internet http://www.ictp.csic.es/qm/paginaWEB_archivos/page0018.htm.
Pegoraro, Mario, Modification of Polymers for the Preparation of Semipermeable Membranes, Pure Appl. Chem., 1972, vol. 30, No. 1-2, pp. 199-216, [online] 17 pages. [retrieved on Jul. 30, 2013]. Retrieved from the Internet www.iupac.org/publications/pac/30/1/0199/pdf/.
Hydranautics, Commercial RO Technology, Jan 23, 2001. [online] 6 pages. [retrieved on Jul. 30, 2013]. Retrieved from the Internet www.membranes.com/docs/trc/commerc.pdf.
Eastman, Cellulose acetate as the semipermeable membrane for osmotic drug delivery systems, 2013. [online] 4 pages. [retrieved on Jul. 30, 2013]. Retrieved from the Internet www.eastman.com/Literature_Center/P/PCI110.pdf.
Optimization of Membrane Treatment for Direct and Clarified Water Filtration, 2006 [online] 4 pages. [retrieved on Jul. 30, 2013]. Retrieved from the Internet books.google.com/books?isbn=1583214615.

* cited by examiner

WELL STIMULATION METHODS AND PROPPANT

TECHNICAL FIELD

Compositions and methods herein pertain to proppant and well stimulation methods, such as those that include proppant with a core containing a swellable material.

BACKGROUND

Wells drilled in low-permeability subterranean formations are often treated by reservoir stimulation techniques, such as hydraulic fracturing, to increase their conductivity and thereby enhance recovery of hydrocarbons. Treatment fluids are pumped at high pressure into the formation to create fractures in the formation. Proppants may be incorporated in the treatment fluids to prop open the created fractures when the surface treating pressure is released. A wide variety of materials may be used for proppant, but it includes a solid material, often sand or ceramic particles.

Over time, fracture size may decrease from mechanical failure (such as, crushing) of proppant, embedding of proppant into the fracture face of the well formation, etc. As the fracture begins to close, hydrocarbon production may decrease. Accordingly, methods to open fractures wider and/or to keep fractures open longer are desirable.

SUMMARY

A well stimulation method includes using a well formation containing fractures and placing proppant in the fractures. A plurality of individual particles of the proppant includes a core containing a swellable material. The method includes swelling the core and increasing a size of the fractures using the swelling core.

A well stimulation method includes hydraulically fracturing a well formation containing hydrocarbon and placing proppant in fractures formed during the fracturing. A plurality of individual particles of the proppant includes a core containing a swellable mortar and includes a dissolvable layer encapsulating the core. The method includes dissolving the dissolvable layer in water or in fluid produced from the hydrocarbon-containing formation and exposing at least a portion of the core. The swellable material is treated with water or with formation fluid and thereby cured. The method includes swelling the curing core in volume by a factor of at least two and increasing a size of the fractures using the swelling core.

A proppant particle includes a core containing a swellable material and a dissolvable layer encapsulating the core.

BRIEF DESCRIPTION OF THE DRAWINGS

Some embodiments are described below with reference to the following accompanying drawings.

DETAILED DESCRIPTION

Figure 1:
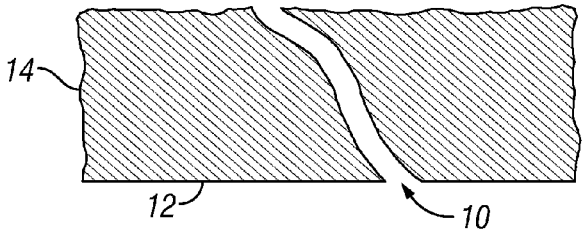
FIGS. 1 to 4 are sequential, cross-sectional diagrams of a well formation demonstrating fracture expansion using the proppant and methods herein.

Methods and compositions herein relate to proppant configured to keep fractures in well formations open longer, to open fractures wider, or both. The proppant includes a swellable material such that proppant particles grow in size, but exhibit substantial strength. Proppant particles may grow in size by reacting with fluid produced from a well formation, such as a hydrocarbon-containing formation, or reacting with the aqueous base of a fracturing fluid. The point in time at which the reaction starts to swell the proppant in size may also be selected.

A wood particle represents one example of a substance that swells when exposed to water. However, a wood particle or swollen wood particle does not exhibit sufficient strength to prop open a fracture or to increase a size of a fracture. Known non-explosive demolition agents are used as alternatives to explosives and other blasting products in demolition and mining. A slurry mixture of the non-explosive demolition agent and water is poured into cracks or holes drilled into a substrate to be cracked and the slurry expands over time as it sets. As a result of the slurry expansion, the substrate cracks in a pattern similar to that which would occur from explosives.

Known agents include DEXPAN available from Dexpan International in Athlone, Ireland. Expansive grout is a similar product known as BUSTAR available from Demolition Technologies, Inc. in Greenville, Ala. DEXPAN contains calcium hydroxide, vitreous silica, diiron trioxide, and aluminum oxide and may produce 18,000 pounds per square inch (psi) of pressure. BUSTAR contains limestone, dolomite, and other additives and produces up to 20,000 psi of pressure, expanding up to four times in volume after several hours. DA-MITE rock splitting mortar available from Daigh Company, Inc. in Cumming, Ga. contains calcium oxide, silicon dioxide, iron oxide, aluminum oxide, and sulfur trioxide and produces up to 20,000 to 40,000 psi of pressure.

Several other swellable material products are known and may be referred to as expansive mortar, expansive cracking agent, etc. Notably, each of the indicated swellable materials is used in a slurry form in which reaction with water begins upon mixing. To those of ordinary skill, such swellable materials are impractical for a well stimulation in which fracturing occurs hundreds if not thousands of feet below the surface with no known delivery technique to the point of crack propagation.

However, in keeping with the methods and compositions herein, swellable materials, such as swellable mortar, may be formed as a material suitable for proppant particles. The swellable material may then be delivered as proppant to fractures in a well formation. According to one embodiment, a well stimulation method includes using a well formation containing fractures and placing proppant in the fractures. A plurality of individual particles of the proppant includes a core containing a swellable material. The method includes swelling the core and increasing a size of the fractures using the swelling core.

By way of example, the method may include fracturing a well formation and placing proppant in the fractures formed during the fracturing. The method may instead include placing proppant in naturally occurring fractures without fracturing. Increasing fracture size may include increasing both width and length.

A variety of possibilities are conceivable in which swellable material may be provided in the form of proppant. In one concept, the plurality of individual particles may include a dissolvable layer encapsulating the core and having a size, hardness, or other properties suitable for proppant. In another concept, the plurality of individual particles may include a core wherein a formulation of the swellable material itself provides a solid form having a size, hardness, or other properties suitable for proppant. Consequently, either by encapsulation of the swellable material or by formulation of the swellable material itself, proppant containing swellable material may be placed in fractures. The method may include dissolving the dissolvable layer and exposing at least a portion of the core. The method may further include curing the swellable material in the exposed core, the swelling including swelling the curing core.

Figure 2:
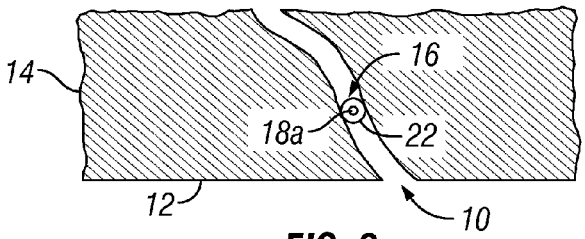
Figure 3:
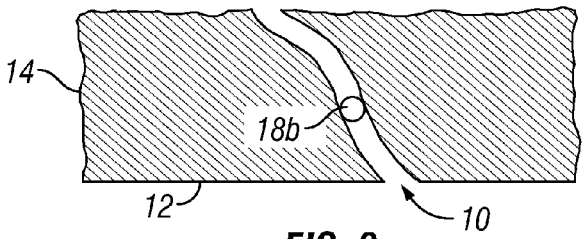
Figure 4:
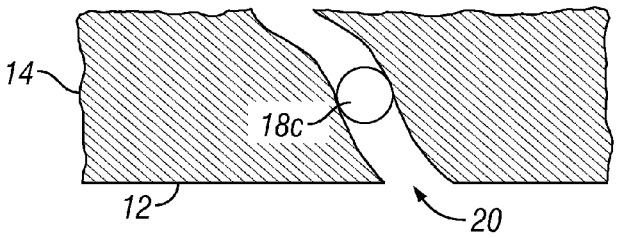

Turning to FIG. 1, a wellbore 12 is shown formed through a formation 14. A fracture 10 is in turn formed in formation 14, propagating from wellbore 12. Known hydraulic fracturing techniques may be used to provide fracture 10. FIG. 2 shows proppant 16 lodged in fracture 10. Known proppant placement techniques may be used to place proppant 16 as shown. Proppant 16 includes a core 18*a* and a dissolvable layer 22 encapsulating core 18*a*. FIG. 3 shows a core 18*b* lodged in fracture 10. Core 18*b* may represent core 18*a* after dissolvable layer 22 dissolves and core 18*a* swells to the size shown in FIG. 3 as core 18*b*. Alternatively, core 18*b* may represent a proppant particle lodged in fracture 10 originally without a dissolvable layer. Regardless of its origination, core 18*b* may swell to the size shown in FIG. 4 as a core 18*c* and increase a size of fracture 10 to provide a fracture 20.

The increase in size of fracture 10 may be in comparison to a size that would otherwise exist without use of swellable material. In one circumstance, known proppant might allow a fracture to decrease in size following release of fracturing pressure. The size decrease might be caused by proppant embedding in the fracture face, proppant damage, etc. Proppant with swellable material could swell to prop the fracture before release of fracturing pressure so that the fracture does not decrease in size following pressure release. Accordingly, the swelling core would increase the size of the fracture relative to what it would have been had it been allowed to collapse without the swelling core. The peak fracture size reached during fracturing would not necessarily increase, although it may.

Consequently, in another circumstance, proppant with swellable material could swell to increase fracture size either before or after release of fracturing pressure. The size increase could be beyond the peak fracture size or beyond a fracture size that would otherwise have been obtained by the fracturing pressure alone. Increasing fracture size may refer to increasing width of a fracture, increasing length of the fracture to penetrate deeper into the formation, or both.

Prior to curing, proppant containing swellable material might not exhibit sufficient hardness, strength, or other properties to prop open fractures by itself. Ceramic particles, often alumina, are stronger than resin coated sand particles, which, in turn, are stronger than uncoated sand particles. Ceramic particles exhibit a Mohs hardness of about 9 and a strength of about 20,000 psi to withstand the closure stresses encountered in fractures. Proppant containing swellable material might exhibit a lower hardness and/or lower strength in its condition as placed in fractures. To the extent that it does, the proppant containing swellable material may be placed along with non-swellable particles as additional proppant to avoid the swellable material collapsing or being expelled from the fracture prior to curing and swelling.

Curing of the swellable material in the exposed core may include treating the swellable material with water, as done for non-explosive demolition agents. However, it is conceivable that curing may include treating the swellable material with fluid produced from a hydrocarbon-containing formation. It is further conceivable, as discussed in more detail below, that proppant curable with water and different proppant curable with formation fluids may be used in combination to provide swelling at different times or under different circumstances. For increased shape retention of the swellable material during its cure, the core of swellable material may contain within it supportive scaffolding. Possible supportive scaffolding includes fibers of bamboo, jute, polymer, or metal, either separate or cross linked, or similar scaffolding, especially when the swellable material wets such scaffolding.

For the case of proppant including a core encapsulated by a dissolvable layer, the dissolving may occur in water. The dissolving may instead occur in fluid produced from the hydrocarbon-containing formation. Further, dissolving may instead occur in acid. In the context of the present document, a "dissolvable" layer refers to a layer that may be soluble in a solvent, such as water or formation fluids. Additionally, a "dissolvable" layer refers to material that may be reactive with a reactant, such as acid. Consequently, dissolving the dissolvable layer may be accomplished by solubility of the layer in solvent or reactivity of the layer with reactants.

The solvent or reactants may be found naturally in the formation environment or added to the formation environment, perhaps for the purpose of exposing the core containing swellable material, as in the case of acid, or for other purposes. It will be appreciated that proppant may be placed in the fracture prior to beginning dissolution of the dissolvable layer, or dissolution may be sufficiently slow that adequate time exists for placing proppant prior to swelling the core. It will also be appreciated that different materials for the dissolvable layer may be used such that one type of material dissolves in water and another type of material dissolves in formation fluids. Proppant containing the two different types of dissolvable layer may be combined such that a well stimulation method includes both types of dissolution.

Solubility and reactivity are often influenced by temperature. Since down-hole temperature at the formation often exceeds surface temperature, consideration could be made regarding dissolution rate at the elevated temperatures encountered by the proppant. Even though a material for the dissolvable layer is not soluble or reactive at surface ambient temperature, conditions encountered in the formation fractures may be adequate to provide suitable dissolution rate.

One material that may be suitable for the dissolvable layer includes the "time delay material, such as a dissolvable material" described in U.S. Pat. No. 7,464,764 issued to Xu, which is incorporated herein by reference for its pertinent and supportive teachings. Suitable dissolvable materials may include polymers and biodegradable polymers, such as polyvinyl alcohol based polymers, including the polymer HYDROCENE available from Idroplax, S.R.L. located in Altopascia, Italy; polylactide ("PLA") polymer 4060D from NATURE-WORKS, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and parafin waxes; polyalkylene oxides, such as polyethylene oxides; polyalkylene glycols, such as polyethylene glycols; and alkali or alkaline earth metals or their alloys. These materials may be beneficial in water-based drilling fluids because they are slowly soluble or degradable in water. Compressed pellets of dry swellable material may be coated with these materials, which may slowly erode away.

Timing for exposure of the core containing the swellable material may also be selected. Depending on the properties of the dissolvable layer, the exposing may occur after a short exposure of more than 1 hour, but likely before less than 5 hours of solvent or reactant treatment. The exposing may instead occur after a long exposure of more than 1 day of solvent or reactant treatment. Additionally, it will be appreciated that dissolvable layers of different properties may be included on proppants combined and used in a well stimulation method such that both the short exposure and the long exposure occur.

The short exposure proppant may assist with increasing a size of fractures after fracturing the well formation, but before hydrocarbon production begins. Such a measure may increase production volume compared to a well stimulation method that lacks increasing the size of fractures. Over time, fracture size may decrease, reducing hydrocarbon production. Therefore, after a period of hydrocarbon production and allowance for a decrease in fracture size, the long exposure proppant may allow exposure of the swellable material and swelling. In turn, increasing the size of the fracture may increase hydrocarbon production after the initial reduction. It is conceivable that additional cycles of increasing fracture size may be accomplished using still further delayed exposure of swellable material.

Figure 5:
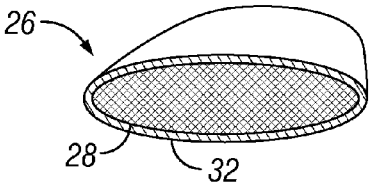
FIGS. 5 and 6 are cross-sectional views of a proppant particle in the form of a flake and a spheroid, respectively.
Figure 6:
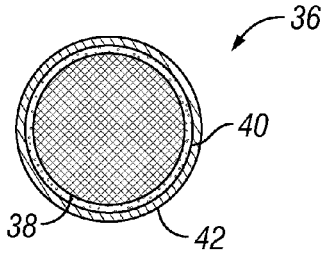

The proppant may be in the form of a variety of shapes and dimensions. FIG. 5 shows a cross-sectional view of a proppant particle in the form of a flake. FIG. 6 shows a cross-sectional view of a proppant particle in the form of a spheroid. A flake shape may be somewhat flat and wide in order to increase the contact area with the fracture face compared to a lower aspect ratio shape, such as a spheroid. The flake may have an aspect ratio of at least about 3:1. The flat flake may lodge into narrow fractures not accessible by other shapes with a larger diameter.

As an example, a flake may have a height of about 0.1 millimeters (mm) and a width of about 3 to about 4 mm. Therefore, that flake may fit into a fracture of about 0.1 mm diameter where larger diameter known proppant would not fit. Known proppant often has a size range from about 12 mesh (1,700 micrometers (μm)) to about 50 mesh (300 μm). Even so, the flake with swellable material may swell to the larger diameter, extending the fracture length. Proppant according to the methods and compositions herein may have a size range similar to that of known proppant from about 12 mesh (1,700 micrometers (μm)) to about 50 mesh (300 μm). For the flake-shaped proppant, at least one of its dimensions may be within such size range or all dimensions may be within the range.

Proppant made from known proppant materials with a flake shape would appear to have little utility in known well stimulation methods given the loss of propping ability due to the flake's height. Even so, the well stimulation methods herein may make beneficial use of a flake shape since the increased contact area allows for increased distribution of force as the proppant swells. The increased contact area also decreases likelihood of proppant embedding in the fracture face. Proppant with swellable material and an aspect ratio of at least about 3:1 may be used to reduce proppant embedding by providing increased contact area compared to known spherical proppant.

Proppant 26 shown in FIG. 5 has a core 28 including a swellable material encapsulated by a dissolvable layer 32. Proppant 36 shown in FIG. 6 likewise includes a core 38 including swellable material encapsulated by a dissolvable layer 42. Additionally, proppant 36 includes permeable layer 40. Permeable layer 40 is shown positioned between dissolvable layer 42 and core 38. Use of permeable layer 40 increases the flexibility in the properties of core 38 that may be suitable.

With the dissolving of dissolvable layer 42, some swellable materials might not remain contained in the spheroid form of FIG. 6 or the flake form of FIG. 5 and may collapse. The powdered material used for non-explosive demolition agents represents one example. For that reason, powdered material or other materials that do not retain their own shape may be encapsulated by a permeable layer. In this manner, after dissolving dissolvable layer 42, core 38 is retained within permeable layer 40 encapsulating core 38. Permeable layer 40 allows treating swellable material with water or formation fluid through the permeable material.

Although not shown in the Figures, it is conceivable that a dissolvable layer may instead be positioned between the permeable layer and the core. Such a permeable layer could then allow dissolving the dissolvable layer as solvent or reactants pass through the permeable layer and dissolve the underlying material. Removal of the dissolvable layer may leave a gap between the core and the permeable layer. Nevertheless, the gap may become occupied as the swellable material of the core swells. In the context of the present document, exposing at least a portion of the core may include dissolving the dissolvable layer to reveal the core or dissolving the dissolvable layer to reveal the permeable layer through which the core is exposed to solvents and/or reactants.

Examples of suitable materials for the permeable layer include aromatic polyamides, cellulose acetate, and other materials known for use as semipermeable membranes for water filtration and osmotic drug delivery. "Semipermeable" refers to material that allows transport of small molecules, such as water, but bars passage of larger molecules, such as protein. As the term is used herein, "permeable" includes semipermeable materials, since they allow transport of at least some molecules, but also includes less selective or non-selective materials that may allow further molecule transport and might not be suitable for water filtration or osmotic drug delivery. For example, reverse osmosis membranes for water purification or water desalination systems are often made out of polyamide deposited on top of a polyethersulfone or polysulfone porous layer. Accordingly, just the porous layer portion of a reverse osmosis membrane might be suitable for permeable layer 40.

Once the core is cured, the swellable material may be self-contained to the point that the permeable layer is no longer necessary to contain the swellable material. Some materials for the permeable membrane may be sufficiently flexible that they stretch with swelling of the core and remain, while others may be less flexible and crack open.

In another embodiment, a well stimulation method includes hydraulically fracturing a well formation containing hydrocarbon and placing proppant in fractures formed during the fracturing. A plurality of individual particles of the proppant includes a core containing a swellable mortar and includes a dissolvable layer encapsulating the core. The method includes dissolving the dissolvable layer in water or in fluid produced from the hydrocarbon-containing formation and exposing at least a portion of the core. The swellable material is treated with water or with formation fluid and thereby cured. The method includes swelling the curing core in volume by a factor of at least two and increasing a size of the fractures using the swelling core. By way of example, the core may swell in volume by a factor of at least four.

In a further embodiment, a proppant particle includes a core containing a swellable material and a dissolvable layer encapsulating the core. By way of example, the particle may be in the form of a flake or a spheroid. The swellable material may exhibit the properties of curing in the presence of water or curing in the presence of fluid produced from a hydrocarbon-containing formation and swelling after curing. The swellable material may include swellable mortar. A permeable layer may also encapsulate the core.

The dissolvable layer may exhibit the property of dissolving in water, dissolving in acid, or dissolving in fluid produced from a hydrocarbon-containing formation. The dissolvable layer may have a thickness and exhibit a dissolution rate sufficient to expose the core after more than 1 hour of solvent or reactant treatment. Also, the thickness and dissolution rate may be sufficient to expose the core after more than 1 hour, but before less than 5 hours, of solvent or reactant treatment. Instead, or in addition, the thickness and dissolution rate may be sufficient to expose the core after more than 1 day, but before less than 2 days of solvent or reactant treatment.

A variety of options exist for implementing the embodiments herein. Given the desired delay in swelling of the encapsulated core, materials with certain dissolution rates may be selected and thicknesses determined to provide the desired delay. A single delay may be designated for all of the proppant with a dissolvable layer. Instead, multiple different delays may be incorporated into the proppant with different compositions, thicknesses, or both for the dissolvable layer.

Consequently, a plurality of the particles may be in a proppant mixture. For one of the plurality, the dissolvable layer may have a thickness and exhibit a dissolution rate sufficient to expose the core after more than 1 hour, but before less than 5 hours, of solvent or reactant treatment. For another of the plurality, the dissolvable layer may have a thickness and exhibit a dissolution rate sufficient to expose the core after more than 1 day of solvent or reactant treatment.

Different solvents or reactants may be selected for dissolving the dissolvable layer depending on the delay. Since fracturing fluid may contain an aqueous base, for one of the plurality, the dissolvable layer may exhibit the property of dissolving in water. Since proppant that is further delayed would be exposed to formation fluids, for another of the plurality, the dissolvable layer may exhibit the property of dissolving in formation fluids. In this manner, the early swelling proppant may dissolve the layer in water and be cured by treatment with water, while the later swelling proppant may dissolve the layer in formation fluid and be cured by treatment with formation fluid.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

| TABLE OF REFERENCE NUMERALS FOR FIGURES |
|---|
| 10 fracture |
| 12 wellbore |
| 14 formation |
| 16 proppant |
| 18a core |
| 18b core |
| 18c core |
| 20 fracture |
| 22 dissolvable layer |
| 26 proppant |

-continued

| TABLE OF REFERENCE NUMERALS FOR FIGURES |
|---|
| 28 core |
| 32 dissolvable layer |
| 36 proppant |
| 38 core |
| 40 permeable layer |
| 42 dissolvable layer |

What is claimed is:

1. A well stimulation method comprising:

using a well formation containing fractures;

placing proppant in the fractures, a plurality of individual particles of the proppant including a core containing a swellable material and having a size range from about 12 mesh (1,700 μm) to about 50 mesh (300 μm);

swelling the core; and after placing the core in the fractures, increasing a size of the fractures by means of the swelling core pressing on a face of a fracture and producing at least 18,000 pounds per square inch (psi) of pressure, the increase being in comparison to a size that would otherwise exist without the swelling core pressing on the face of the fracture, the swelling core exhibiting sufficient strength itself to cause the increase in fracture size.

2. The method of claim 1 further comprising:

the plurality of individual particles further includes a dissolvable layer encapsulating the core;

dissolving the dissolvable layer and exposing at least a portion of the core; and curing the swellable material in the exposed core of the proppant particle to the strength sufficient itself to cause the increase in fracture size, the swelling of the core including swelling the curing core.

3. The method of claim 2 wherein the dissolving comprises dissolving in water, dissolving in acid, or dissolving in fluid produced from a hydrocarbon-containing formation.

4. The method of claim 2 wherein the dissolving occurs in water, or the dissolving occurs in fluids produced from a hydrocarbon-containing formation, or both.

5. The method of claim 2 wherein the exposing occurs after more than 1 hour, but before less than 5 hours, of solvent or reactant treatment, or the exposing occurs after more than 1 day of solvent or reactant treatment, or both.

6. The method of claim 2 wherein the curing comprises treating the swellable material with water, or the curing comprises treating the swellable material with fluid produced from a hydrocarbon-containing formation, or both.

7. The method of claim 6 wherein the plurality of individual particles further includes a permeable layer between the dissolvable layer and the core and the treatment of the swellable material in the exposed core occurs through the permeable layer encapsulating the core.

8. The method of claim 2 wherein the dissolvable layer has a thickness and exhibits a dissolution rate sufficient to expose the core after more than 1 hour of solvent or reactant treatment.

9. The method of claim 8 wherein the thickness and dissolution rate are sufficient to expose the core after more than 1 hour, but before less than 5 hours, of solvent or reactant treatment.

10. The method of claim 8 wherein the thickness and dissolution rate are sufficient to expose the core after more than 1 day, but before less than 2 days, of solvent or reactant treatment.

11. The method of claim 2 wherein, for one of the plurality of individual particles, the dissolvable layer has a thickness and exhibits a dissolution rate sufficient to expose the core after more than 1 hour, but before less than 5 hours, of solvent or reactant treatment and, for another of the plurality, the dissolvable layer has a thickness and exhibits a dissolution rate sufficient to expose the core after more than I day of solvent or reactant treatment.

12. The method of claim 2 wherein, for one of the plurality of individual particles, the dissolvable layer exhibits the property of dissolving in water and, for another of the plurality, the dissolvable layer exhibits the property of dissolving in fluids produced from a hydrocarbon-containing formation.

13. The method of claim 1 wherein the proppant further comprises a plurality of non-swellable particles.

14. The method of claim 1 further comprising increasing hydrocarbon production volume using the increasing of the size of fractures compared to a well stimulation method that lacks the increasing of the size of fractures using the swelling core.

15. The method of claim 1 wherein the plurality of individual particles are in the form of flakes or spheroids.

16. The method of claim 15 wherein the plurality of individual particles are in the form of flakes and exhibit an aspect ratio of at least 3:1.

17. The method of claim 16 further comprising reducing particle embedding by increasing contact area compared to a spherical particle.

18. The method of claim 1 wherein the swellable material comprises swellable mortar.

19. The method of claim 18 further comprising treating the swellable mortar with water, with fluid produced from a hydrocarbon-containing formation, or both and thereby reacting the swellable mortar in the core of the proppant particle to the strength sufficient itself to cause the increase in fracture size, the swelling of the core including swelling the reacting core.

20. The method of claim 19 wherein the swellable mortar comprises a mixture of calcium hydroxide, vitreous silica, diiron trioxide, and aluminum oxide, or a mixture of limestone and dolomite, or a mixture of calcium oxide, silicon dioxide, iron oxide, aluminum oxide, and sulfur trioxide.

21. The method of claim 1 further comprising stimulating the production of hydrocarbons using the increased fracture size.

22. The method of claim 1 further comprising fracturing the well formation, wherein the proppant is placed in fractures formed during the fracturing, and wherein another plurality of individual particles of the proppant are non-swellable, the increase in size being in comparison to a size that would otherwise exist without the swelling core and that results from the fracturing and the placing of the non-swellable proppant.

23. A well stimulation method comprising:

hydraulically fracturing a well formation containing hydrocarbon;

placing proppant in fractures formed during the fracturing, a plurality of individual particles of the proppant including a core containing a swellable mortar, including a dissolvable layer encapsulating the core, and having a size range from about 12 mesh (1,700 μm) to about 50 mesh (300 μm);

dissolving the dissolvable layer in water or in fluid produced from a hydrocarbon-containing formation and exposing at least a portion of the core;

treating the swellable mortar with water or with fluid produced from a hydrocarbon-containing formation and thereby reacting the swellable mortar in the exposed core of the proppant particle;

swelling the reacting core in volume by a factor of at least two; and after placing the core in the fractures, increasing a size of the fractures by means of the swelling core pressing on a face of a fracture and producing at least 18,000 pounds per square inch (psi) of pressure, the increase being in comparison to a size that would otherwise exist without the swelling core pressing on the face of the fracture and that results from the hydraulic fracturing, the swelling core exhibiting sufficient strength itself to cause the increase in fracture size.

24. The method of claim 23 wherein the swellable mortar comprises a mixture of calcium hydroxide, vitreous silica, diiron trioxide, and aluminum oxide, or a mixture of limestone and dolomite, or a mixture of calcium oxide, silicon dioxide, iron oxide, aluminum oxide, and sulfur trioxide.

25. A well stimulation method comprising:

fracturing a well formation;

placing proppant in fractures formed during the fracturing, a plurality of individual particles of the proppant including a core containing a swellable mortar and having a size range from about 12 mesh (1,700 μm) to about 50 mesh (300 μm), and another plurality of individual particles of the proppant being non-swellable;

treating the swellable mortar with water, with fluid produced from a hydrocarbon-containing formation, or both and thereby reacting the swellable mortar in the core of the proppant particle;

swelling the reacting core in volume by a factor of at least two; and after placing the core in the fractures, increasing a size of the fractures by means of the swelling core pressing on a face of a fracture and producing at least 18,000 pounds per square inch (psi) of pressure, the increase being in comparison to a size that would otherwise exist without the swelling core pressing on the face of the fracture and that results from the fracturing and the placing of the non-swellable proppant, the swelling core exhibiting sufficient strength itself to cause the increase in fracture size.

26. The method of claim 25 wherein the swellable mortar comprises a mixture of calcium hydroxide, vitreous silica, diiron trioxide, and aluminum oxide, or a mixture of limestone and dolomite, or a mixture of calcium oxide, silicon dioxide, iron oxide, aluminum oxide, and sulfur trioxide.

* * * * *